US009090037B2

(12) United States Patent
Swenson

(10) Patent No.: US 9,090,037 B2
(45) Date of Patent: Jul. 28, 2015

(54) CONVERTIBLE SHIPPING CONTAINER HAVING REINFORCED CORNERS AND BLANKS FOR MAKING THE SAME

(75) Inventor: Matthew Kiev Swenson, Wood Dale, IL (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 352 days.

(21) Appl. No.: 13/529,886

(22) Filed: Jun. 21, 2012

(65) Prior Publication Data

US 2013/0334295 A1 Dec. 19, 2013

Related U.S. Application Data

(60) Provisional application No. 61/660,523, filed on Jun. 15, 2012.

(51) Int. Cl.

| | |
|---|---|
| ***B65D 5/54*** | (2006.01) |
| ***B31B 49/02*** | (2006.01) |
| ***B31B 1/00*** | (2006.01) |
| ***B65D 5/02*** | (2006.01) |
| ***B65D 5/44*** | (2006.01) |

(52) U.S. Cl.

CPC ..... *B31B 1/00* (2013.01); *B65D 5/0227* (2013.01); *B65D 5/443* (2013.01); *B65D 5/54* (2013.01); *B65D 5/542* (2013.01); *B65D 2571/00574* (2013.01)

(58) Field of Classification Search

USPC ..... 229/925, 120.03, 235; 493/83, 82; 206/746

See application file for complete search history.

(56) References Cited

U.S. PATENT DOCUMENTS

| | | | | |
|---|---|---|---|---|
| 2,115,673 | A | 4/1938 | Stompe et al. | |
| 3,315,875 | A * | 4/1967 | Praetorius | 229/242 |
| 3,639,937 | A | 2/1972 | Sweeney | |
| 4,318,474 | A | 3/1982 | Hasegawa | |
| 5,657,872 | A | 8/1997 | Leftwich et al. | |
| 5,918,801 | A | 7/1999 | Milio | |
| 5,957,294 | A | 9/1999 | Kanter | |
| 5,979,749 | A | 11/1999 | Bozich | |
| 6,027,017 | A | 2/2000 | Kuhn et al. | |
| 6,073,833 | A | 6/2000 | Desrosiers et al. | |
| 6,168,027 | B1 | 1/2001 | Esser | |
| 6,405,921 | B1 | 6/2002 | Cochrane | |
| 7,021,468 | B2 | 4/2006 | Cargile | |
| 7,080,736 | B2 | 7/2006 | Jackson et al. | |
| 7,607,566 | B2 | 10/2009 | Philips et al. | |
| 7,699,214 | B2 | 4/2010 | Mestre et al. | |
| 7,784,676 | B2 * | 8/2010 | Borek et al. | 229/242 |
| 2004/0232039 | A1 | 11/2004 | Daniels | |
| 2005/0263434 | A1 | 12/2005 | Tibbels | |
| 2006/0060643 | A1 | 3/2006 | Sheffer | |
| 2007/0164093 | A1 * | 7/2007 | Spivey et al. | 229/122 |
| 2008/0217210 | A1 | 9/2008 | Banwarth | |
| 2010/0147933 | A1 * | 6/2010 | Blin | 229/117.13 |
| 2011/0186476 | A1 | 8/2011 | Poitevin et al. | |
| 2012/0298732 | A1 * | 11/2012 | Stewart et al. | 229/122 |

* cited by examiner

*Primary Examiner* — Christopher Demeree
(74) *Attorney, Agent, or Firm* — Armstrong Teasdale LLP

(57) ABSTRACT

A blank of sheet material for forming a convertible shipping container is provided. The blank includes a removable access panel, a top panel, a bottom panel, a front panel, and a rear panel. Each of top, bottom, rear, and front panels include side flaps extending from a side edge of each top, bottom, rear, and front panel. The removable access panel includes an access hole, a return hole, and relief creases to facilitate removal after the container is formed. The shipping container includes a top wall, a bottom wall, a front wall, a rear wall, a first side wall, a second side wall, and four corner structures.

24 Claims, 6 Drawing Sheets

CONVERTIBLE SHIPPING CONTAINER HAVING REINFORCED CORNERS AND BLANKS FOR MAKING THE SAME

CROSS REFERENCE TO RELATED APPLICATIONS

This application claims priority to U.S. Provisional Application No. 61/660,523 filed Jun. 15, 2012, which is hereby incorporated by reference in its entirety.

BACKGROUND OF THE INVENTION

The embodiments described herein relate generally to blanks for forming convertible shipping containers and, more particularly, to blanks for forming convertible shipping containers having reinforced corners.

It has become more common to display goods such as household products in the containers in which they are shipped. This avoids the need to unpack the containers and place the products on shelves. It also provides an opportunity to place attractive advertising matter on the container where it will be seen by consumers at the point of purchase. However, this trend does require that the container be adapted to display the goods.

A problem which has occurred in containers in which cutouts have been made is that a loss of strength results from the cutting of one or more panels of the container. Such containers lack the stacking strength required to prevent the containers from collapsing when they are stacked on top of one another during transport or during display within a store. This is especially the case when the panel cut is a panel supporting the weight of the container and its contents, like the front panel. This is true even of corrugated containers.

Furthermore, standard wrap-style display boxes do not allow for the easy removal of products when the box is displayed on store shelves, and those that do have an opening typically provide only a small opening or the opening includes reinforced material that blocks easy removal of the product.

Accordingly, there remains a need for a convertible shipping container that may be used to display the products contained within the container while also providing adequate stacking strength to prevent collapse and having an opening to allow for easy removal of the product.

BRIEF DESCRIPTION OF THE INVENTION

In one aspect, a shipping container is provided. The shipping container includes a front wall, a first side wall, a rear wall, and a second side wall wherein each of the front wall, the first side wall, the rear wall and the second side wall have top and bottom edges and opposing side edges. The shipping container further includes a top wall, which has opposing side edges, connected to the front wall along the top edge of the front wall. The top wall is also connected to the rear wall along the top edge of the rear wall. The shipping container also includes a bottom wall. The shipping container includes a removable access panel having a front portion and a top portion, wherein said front and top portions are defined by a continuous line of weakness extending from said top wall into said front wall. When the removable access panel is removed, a first access opening is created within the top wall and a second access opening is created within said front wall. The first access opening comprises a substantial portion of the top wall, and the second access opening comprises a substantial portion of the front wall.

In another aspect, a blank of sheet material for forming a shipping container is provided. The blank comprises a bottom panel, a front panel, a top panel, and a rear panel coupled in series by a plurality of fold lines, wherein each of the bottom panel, the front panel, the top panel, and the rear panel include opposing side edges. The blank also includes opposing side flaps coupled by a plurality of fold lines to each of the opposing side edges of each of the bottom panel, the front panel, the top panel, and the rear panel. The blank further includes a removable access panel having a front portion and a top portion, wherein the front and top portions are defined by a continuous line of weakness extending from the top panel into said front panel. When the removable access panel is removed, a first access opening is created within the top panel and a second access opening is created within the front panel. The first access opening comprises a substantial portion of the top panel, and the second access opening comprises a substantial portion of the front panel.

In another aspect, a method for forming a shipping container from a blank of sheet material is provided. The blank includes a bottom panel, a front panel, a top panel, and a rear panel coupled in series by a plurality of fold lines, wherein each of the bottom panel, the front panel, the top panel, and the rear panel include opposing side edges, the blank further comprising opposing side flaps coupled by a plurality of fold lines to each of the opposing side edges of each of the bottom panel, the front panel, the top panel, and the rear panel, the blank also comprising a removable access panel having a front portion and a top portion, wherein the front and top portions are defined by a continuous line of weakness extending from the top panel into the front panel, the blank further includes a glue panel. The method comprises coupling the glue panel to the rear panel such that the bottom panel, the front panel, the top panel, and the rear panel form an open sided box-shape. Opposing side flaps of the front and rear panels are then rotated about the fold lines toward interior of the open sided box-shape. The method further includes rotating the opposing side flaps of the top and bottom panels about the fold lines toward interior of the open sided box-shape. Opposing side flaps of the front and rear panels are then coupled to opposing side flaps of the top and bottom panels to form a first and second side wall. Removable access panel is removed such that a first access opening is created within the top panel and a second access opening is created within the front panel, wherein the first access opening comprises a substantial portion of the top panel, and the second access opening comprises a substantial portion of the front panel.

BRIEF DESCRIPTION OF THE DRAWINGS

FIG. 1 is a top plan view of an exemplary blank of sheet material for forming a container.

FIG. 2 is a perspective side view of an exemplary shipping container formed from the blank shown in FIG. 1.

FIG. 3 is a perspective view of an exemplary shipping container formed from the blank shown in FIG. 1 having the top portion of a removable access panel detached.

FIG. 4 is a perspective view of an exemplary shipping container formed from the blank shown in FIG. 1 having top and front portions of a removable access panel detached.

FIG. 5 is a perspective front view of an exemplary shipping container formed from the blank shown in FIG. 1 having removable access panel detached.

FIG. 6 is a perspective side view of an exemplary shipping container formed from the blank shown in FIG. 1 having removable access panel detached.

DETAILED DESCRIPTION OF THE INVENTION

The embodiments described herein provide a stackable, reinforced container formed from a single sheet of material and a method for constructing the container. The container is sometimes referred to as a retail ready package (RRP) or a wrap-style box as sheet material may be wrapped around the product to form the container. The container may be constructed from a blank of sheet material using at least one machine.

In one embodiment, the blanks are fabricated from a cardboard material. The blanks, however, may be fabricated using any suitable material, and therefore are not limited to a specific type of material. In alternative embodiments, the blanks are fabricated using cardboard, plastic, fiberboard, paperboard, foamboard, corrugated paper, and/or any suitable material known to those skilled in the art and guided by the teachings herein provided. The container may have any suitable size, shape, and/or configuration, whether such sizes, shapes, and/or configurations are described and/or illustrated herein. Further, different embodiments described here can vary in size and/or dimensions although similar labels are used for each embodiment. For example, although a depth is labeled similarly throughout the description, each embodiment can have varying depths.

In an example embodiment, the container includes at least one marking thereon including, without limitation, indicia that communicates the product stored in the tray, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

The following detailed description illustrates the disclosure by way of example and not by way of limitation. The description clearly enables one skilled in the art to make and use an exemplary container, describes several embodiments, adaptations, variations, alternatives, and use of the blanks and/or containers, including what is presently believed to be the best mode of carrying out the disclosure.

Figure 1:
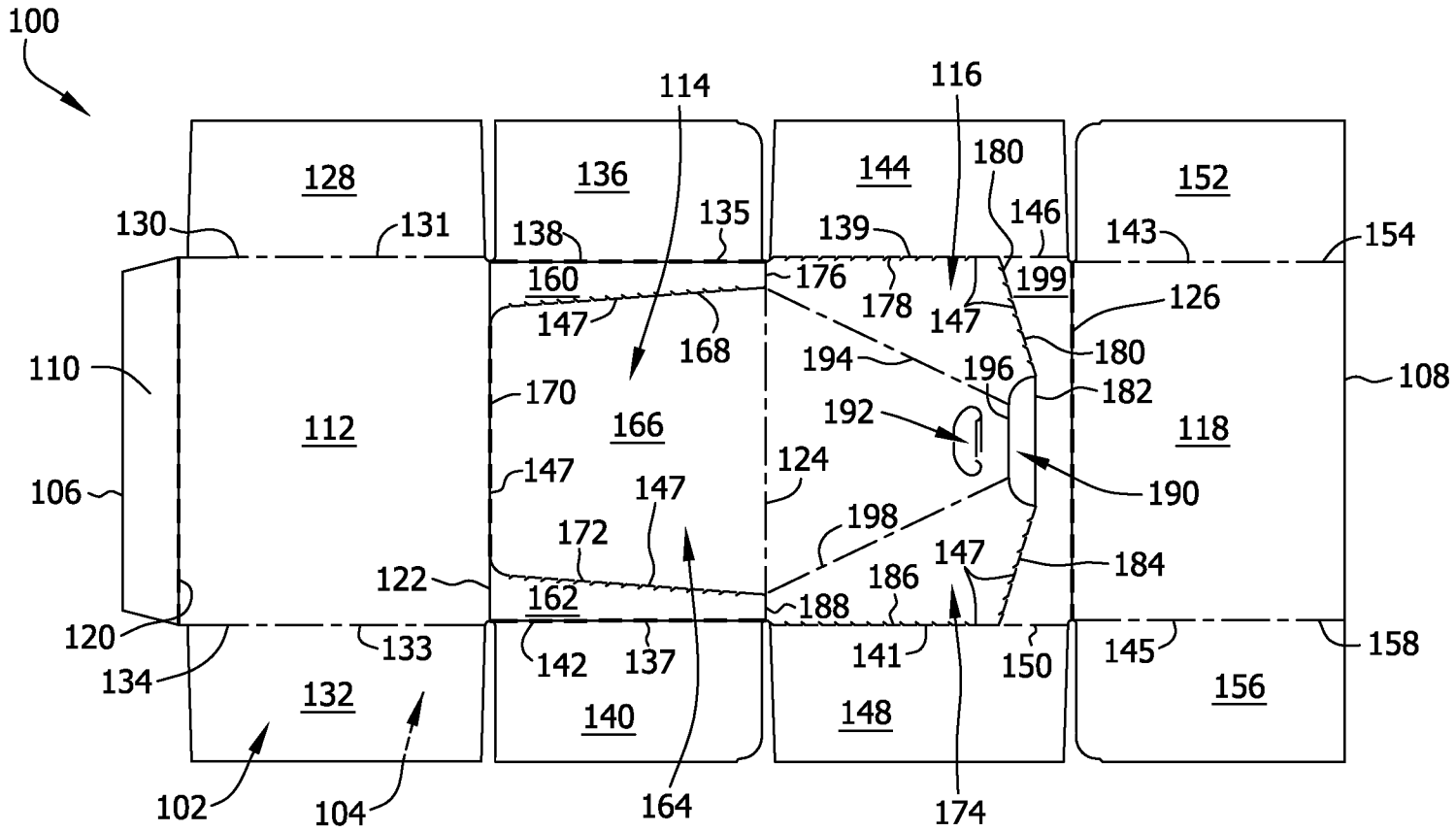
FIGS. 1-6 show exemplary embodiments of the blanks and containers described herein.

Referring now to the figures, FIG. 1 is a top plan view of an exemplary blank 100 of sheet material for forming a container 200 (shown in FIG. 2-7). Blank 100 has an interior surface 102 and an opposing exterior surface 104. Further, blank 100 defines a first edge 106 and an opposing second edge 108. In one embodiment, blank 100 includes, in series from first edge 106 to second edge 108, a glue flap 110, a bottom panel 112, a front panel 114, a top panel 116, and a rear panel 118 coupled together along preformed, generally parallel, fold lines 120, 122, 124, and 126, respectively.

A first bottom side flap 128 extends from a first end edge of bottom panel 112 along a fold line 130, and an opposing second bottom side flap extends from a second end edge of bottom panel 112 along a fold line 132. Fold line 130 defines a first bottom side edge 131 and fold line 134 defines a second bottom side edge 133. Side edges 131 and 133 are opposing side edges of bottom panel 112. Glue flap 110 extends from bottom panel 112 and is configured to couple bottom panel 112 to rear panel 118. A first front side flap 136 extends from a first end edge of front panel 114 along a fold line 138, and an opposing second front side flap 140 extends from a second end edge of front panel 114 along a fold line 142. Fold line 138 defines a first front side edge 135 and fold line 142 defines a second front side edge 137. Side edges 135 and 137 are opposing side edges of front panel 114. A first top side flap 144 extends from a first end edge of top panel 116 along a fold line 146, and an opposing second top side flap 148 extends from a second end edge of top panel 116 along a fold line 150. Fold line 146 defines a first top side edge 139 and fold line 150 defines a second top side edge 141. Side edges 139 and 141 are opposing side edges of top panel 116. A first rear side flap 152 extends from a first end edge of rear panel 118 along a fold line 154, and an opposing second rear side flap 156 extends from a second end edge of rear panel 118 along a fold line 158. Fold line 154 defines a first rear side edge 143 and fold line 158 defines a second rear side edge 145. Side edges 143 and 145 are opposing side edges of rear panel 118.

Front panel 114 includes a front portion 164 of a removable access panel 166. Front portion 164 of removable access panel 166 is defined in series within front panel 114 by perforated lines 168, 170, and 172 and by fold line 124. Perforated line 168 begins a distance inward toward front panel 114 from fold line 138 along fold line 124 and extends between fold line 124 and fold line 122 such that perforated line 168 is not parallel to fold line 138. Perforated line 172 begins a distance inward toward front panel 114 from fold line 142 along fold line 124 and extends between fold line 124 and fold line 122 such that perforated line 172 is not parallel to fold line 142. Perforated line 170 extends along fold line 122 between perforated line 168 and perforated line 172 such that perforated line 170 is shorter than fold line 122. Front panel 114 also includes a second front shoulder portion 160 coupled to first front side flap 136 by fold line 138. Second front shoulder portion 160 is defined in series by fold line 138, a portion of fold line 122, perforated line 168, and a portion of fold line 124. Front panel 114 further includes a first front shoulder portion 162 coupled to second front side flap 140 by fold line 142. Second front shoulder portion is defined in series by fold line 142, a portion of fold line 122, perforated line 172, and a portion of fold line 124. Front shoulder portions 160 and 162 together with front portion 164 of removable access panel 166 define front panel 114. Perforated lines 168 and 172 extend between top panel 116 and bottom panel 112 at a distance spaced from opposing side edges 135 and 137, respectively. Front shoulder portions 160 and 162 extend inward from opposing side edges 135 and 137, respectively. When formed, the combination of first front shoulder portion 162 and at least one of side flaps 132, 140, 148, and/or 156 define a first corner structure 228 (shown in FIG. 5). When formed, the combination of second front shoulder portion 160 and at least one of side flaps 128, 136, 144, and/or 152 define a second corner structure 230 (shown in FIG. 5).

Top panel 116 includes a top portion 174 of removable access panel 166. Top portion 174 of removable access panel 166 includes an access window 190 extending from interior surface 102 to exterior surface 104 for receiving the fingers of a worker and a return flap 192 extending from exterior surface 104 to interior surface 102 where the worker's fingertips return through removable access panel 166. Access window 190 and return flap 192 are configured to facilitate removal of removable access panel 166.

Top portion 174 of removable access panel 166 is defined in series within top panel 116 by perforated lines 176, 178, 180, along top edge 182 of access window 190, and continuously defined by perforated lines 184, 186, and 188. Perforated lines 176 and 188 extend from fold lines 146 and 150, respectively, to perforated lines 168 and 172, respectively. Perforated lines 178 and 186 extend from fold line 124 along fold lines 146 and 150, respectively, to perforated lines 180 and 184, respectively. Perforated lines 180 and 184 extend inward on top panel 116 from fold lines 146 and 150, respectively, to opposing ends of top edge 182 of access hole. Specifically, removable access panel 166 includes top portion 174 and front portion 164, and removable access panel 166 is defined in its entirety in series by continuous line of weakness 147 made up of perforated lines 176, 178, 180, edge 182, perforated lines 184, 186, 188, 172, 170, and 168 that extends from top panel 116 into front panel 114. Top portion 174 of removable access panel 166 further includes relief crease 194 extending from the intersection of perforated lines 168 and 176 across top portion 174 to a bottom edge 196 of access window 190. Top portion 174 also includes a complimentary relief crease 198 extending from the intersection of perforated lines 172 and 188 across top portion 174 to bottom edge 196 of access window 190. Relief creases 194 and 198 are configured to facilitate removal of removable access panel 166.

Top panel 116 further includes a top shoulder portion 199 defined in series by fold line 126, a portion of fold line 150, perforated line 184, top edge 182, perforated line 180, and a portion of fold line 146. Top shoulder portion 199 and top portion 174 of removable access panel 166 together define top panel 116. When removable access panel 166 is removed, a first access opening 224 (shown in FIG. 2) is created within top panel 116 and a second access opening 226 (shown in FIG. 2) is created within front panel 114. First access opening 224 comprises a substantial portion of the top panel 116, and second access opening 226 comprises a substantial portion of front panel 114. When removable access panel 166 is removed, top shoulder portion 199 remains to maintain structure for providing stacking strength.

Continuous line of weakness 147 extends within top panel 116 along at least a portion of opposing side edges 139 and 141 of top panel 116 and between opposing side edges 139 and 141 of top panel 116 such that top shoulder portion 199 extends between opposing side edges 139 and 141 and from fold line 126 to continuous line of weakness 147. When formed, the combination of rear panel 118, at least one of opposing side flaps 128, 136, 144, and/or 152, and top shoulder portion 199 define a third corner structure 232 (shown in FIG. 5). When formed, the combination of rear panel 118, at least one of opposing side flaps 132, 140, 148, and/or 156, and top shoulder portion 199 define a fourth corner structure 234 (shown in FIG. 5). Corner structures 228 and 230 extend a full length of opposing side edges 135 and 137, respectively. Corner structures 232 and 234 extend a full length of top shoulder portion 199 in a first direction and a full length of opposing side edges 143 and 145 of rear panel 118 in a second direction, said second direction being perpendicular to said first direction.

Figure 2:
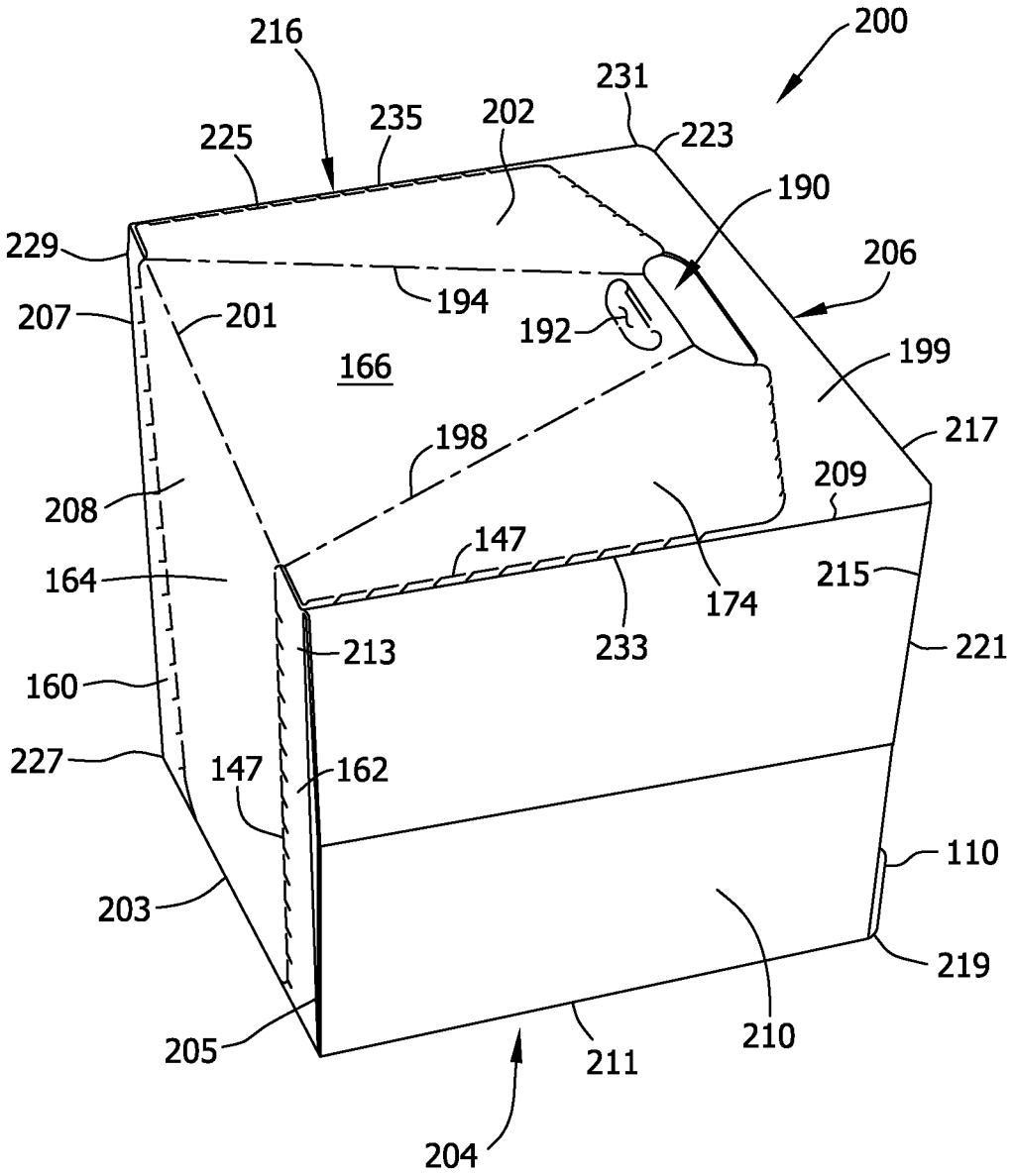

FIG. 2 is a perspective view of an exemplary shipping container 200 formed from blank 100 (shown in FIG. 1). When formed, container 200 includes a top wall 202, a bottom wall 204, a rear wall 206, a front wall 208, a first side wall 210, and a second side wall 216. Front wall 208 is parallel to rear wall 206, and first side wall 210 is parallel to second side wall 216, where both first and second side walls 210 and 216 are perpendicular to both front and rear walls 208 and 206.

Front wall 208 includes top edge 201, bottom edge 203, first side edge 205, and second side edge 207; where first and second side edges 205 and 207 are opposing side edges. First side wall 210 includes a top edge 209, a bottom edge 211, a first side edge 213, and a second side edge 215; where first and second side edges 213 and 215 are opposing side edges. Rear wall 206 includes a top edge 217, a bottom edge 219, a first side edge 221, and a second side edge 223; where first and second side edges 221 and 223 are opposing side edges. Second side wall 216 includes a top edge 225, a bottom edge 227, a first side edge 229, and a second side edge 231; where first and second side edges 229 and 231 are opposing side edges. Top wall 202 includes a first side edge 233 and a second side edge 235; where first and second side edges 233 and 235 are opposing side edges.

Top wall 202 is formed from top portion 174 of removable access panel 166 and top shoulder 199. Top wall further includes access window 190 and return flap 192. Bottom wall 204 is formed from bottom panel 112. Rear wall 206 is formed from rear panel 118. Glue flap 110 overlaps a portion of rear panel 118, causing rear wall 206 to be multi-layered in the overlapped portion. Front wall 208 is formed from front portion 164 of removable access panel 166 and front shoulders 160 and 162. First side wall 210 is double-walled having an inside layer 212 and an outside layer 214. Inside layer 212 of first side wall 210 is formed from second front side flap 140 and second rear side flap 156. Outside layer 214 of first side wall 210 is formed from second bottom side flap 132 and second top side flap 148. Second side wall 216 is also a multi-layer wall having an inside layer 218 and an outside layer 220. Inside layer 218 of second side wall 216 is formed from first front side flap 136 and first rear side flap 152. Outside layer 220 of second side wall 216 is formed from first bottom side flap 128 and first top side flap 144.

In the exemplary embodiment, container 200 also includes removable access panel 166 having front portion 164 and top portion 174, wherein front and top portions 164 and 174 are defined by continuous line of weakness 147 extending from top wall 202 into front wall 208. When removable access panel 166 is removed, first access opening 224 (shown in FIG. 4) is created within top wall 202 and second access opening 226 (shown in FIG. 4) is created within front wall 208. First access opening 224 comprises a substantial portion of top wall 202, and second access opening 226 comprises a substantial portion of front wall 208.

In the exemplary embodiment, continuous line of weakness 147 extends within front wall 208 at a distance spaced from opposing side edges 205 and 207 and at least partially along the bottom edge 203 of front wall 208 to define second front shoulder portion 160 and first front shoulder portion 162, front shoulder portions 160 and 162 extend inward from opposing side edges 207 and 205, respectively, of front wall 208. When container 200 is formed, the combination of first front shoulder portion 162 and first side wall 210 define first corner structure 228 (shown in FIG. 5), and the combination of second shoulder portion 160 and second side wall 216 define second corner structure 230 (shown in FIG. 5). Continuous line of weakness 147 further extends within top wall 202 along at least a portion of opposing side edges 233 and 235 and between opposing side edges 233 and 235 such that top shoulder portion 199 extends between top edge 217 of rear wall 206 and continuous line of weakness 147. When container 200 is formed, the combination of second side wall 216, rear wall 206, and top shoulder portion 199 define a third corner structure 232 (shown in FIG. 5) and a fourth corner structure 234 (shown in FIG. 5). Corner structures 228, 230, 323, and 234 extend a full height of container 200 between bottom wall 204 and top wall 202.

Referring to FIGS. 1 and 2, to form container 200 from blank 100, adhesive is applied to the interior surface 102 of glue flap 110, and rear panel 118 is rotated about fold line 126 toward interior surface of blank 100 such that second edge 108 meets fold line 120. Glue flap 110 extends from bottom wall 204 and is configured to couple bottom wall 204 to rear wall 206. Glue flap 110 is then rotated about fold line 120 such that interior surface 102 of glue flap 110 is coupled to exterior surface 104 of rear panel 118, such that bottom panel 112, front panel 114, top panel 116, and rear panel 118 form an open sided box-shape. As such, front wall 208 is substantially parallel to rear wall 206, with first and second side walls 210 and 216, top wall 202, and bottom wall 204 extending therebetween; first and second side walls 210 and 216 being substantially parallel to each other and top wall 202 being substantially parallel to bottom wall 204.

First front side flap 136 is rotated about fold line 138 toward interior surface 102 of rear wall 206, and first rear side flap 152 is rotated about fold line 154 toward interior surface 102 of front wall 208, thus forming inside layer 218 of second side wall 216. First top side flap 144 is rotated about fold line 146 toward interior surface 102 of bottom wall 204, and first bottom side flap 128 is rotated about fold line 130 toward interior surface 102 of top wall 202, thus forming outside layer 220 of second side wall 216. The exterior surfaces 104 of first front side flap 136 and first rear side flap 152 are coupled to the interior surfaces 102 of first top side flap 144 and first bottom side flap 128.

Second front side flap 140 is rotated about fold line 142 toward interior surface 102 of rear wall 206, and second rear side flap 156 is rotated about fold line 158 toward interior surface 102 of front wall 208, thus forming inside layer 212 of first side wall 210. Second top side flap 148 is rotated about fold line 150 toward interior surface 102 of bottom wall 204, and second bottom side flap 132 is rotated about fold line 134 toward interior surface 102 of top wall 202, thus forming outside layer 214 of first side wall 210. The exterior surfaces 104 of second front side flap 140 and second rear side flap 156 are coupled to the interior surfaces 102 of second top side flap 148 and second bottom side flap 132.

Figure 3:
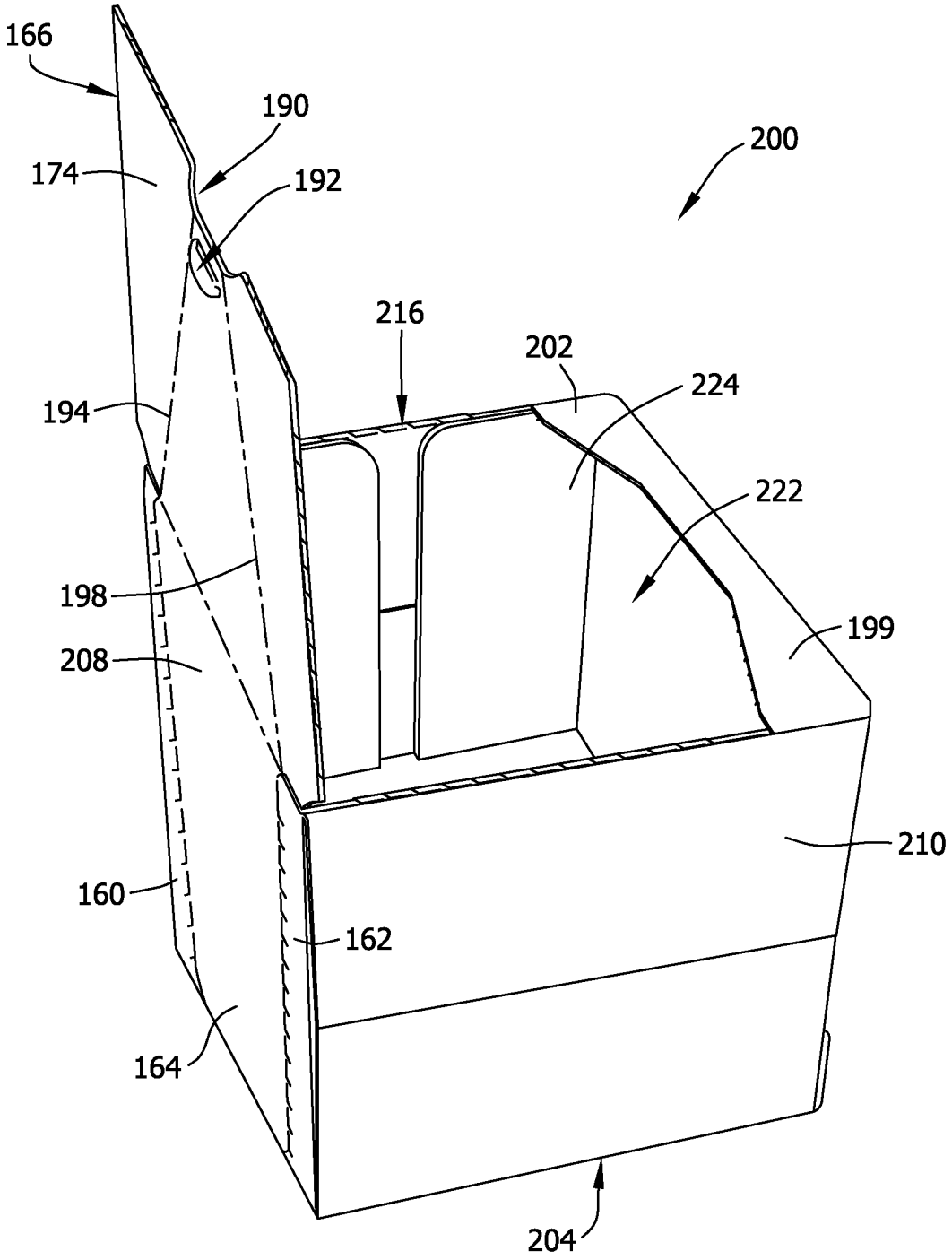

FIG. 3 is a perspective view of an exemplary container 200 formed from blank 100 (shown in FIG. 1) having top portion 174 of removable access panel 166 detached. A worker's fingers are inserted into access window 190 (shown in FIG. 1) toward bottom wall 204 and return through return flap 192. A pulling force is then applied in an upward direction away from container 200 such that top portion 174 of removable access panel 166 is detached from top wall 202. The force applied causes perforated line 176 to tear away from second front shoulder portion 160, perforated line 178 to tear away from first top side flap 144, perforated lines 180 and 184 to tear away from top shoulder portion 199, perforated line 186 to tear away from second top side flap 148, and perforated line 188 to tear away from first front shoulder portion 162. The removal of top portion 174 of removable access panel 166 exposes a cavity 222 inside container 200 in which product will be housed. Relief creases 194 and 198, access window 190, and return flap 192 are configured to facilitate the removal to top portion 174 of removable access panel 166. The removal of top portion 174 of removable access panel 166 also defines a first access opening 224 extending between first and second side walls 210 and 216 and front wall 208 and top shoulder portion 199 of top wall 202.

Figure 4:
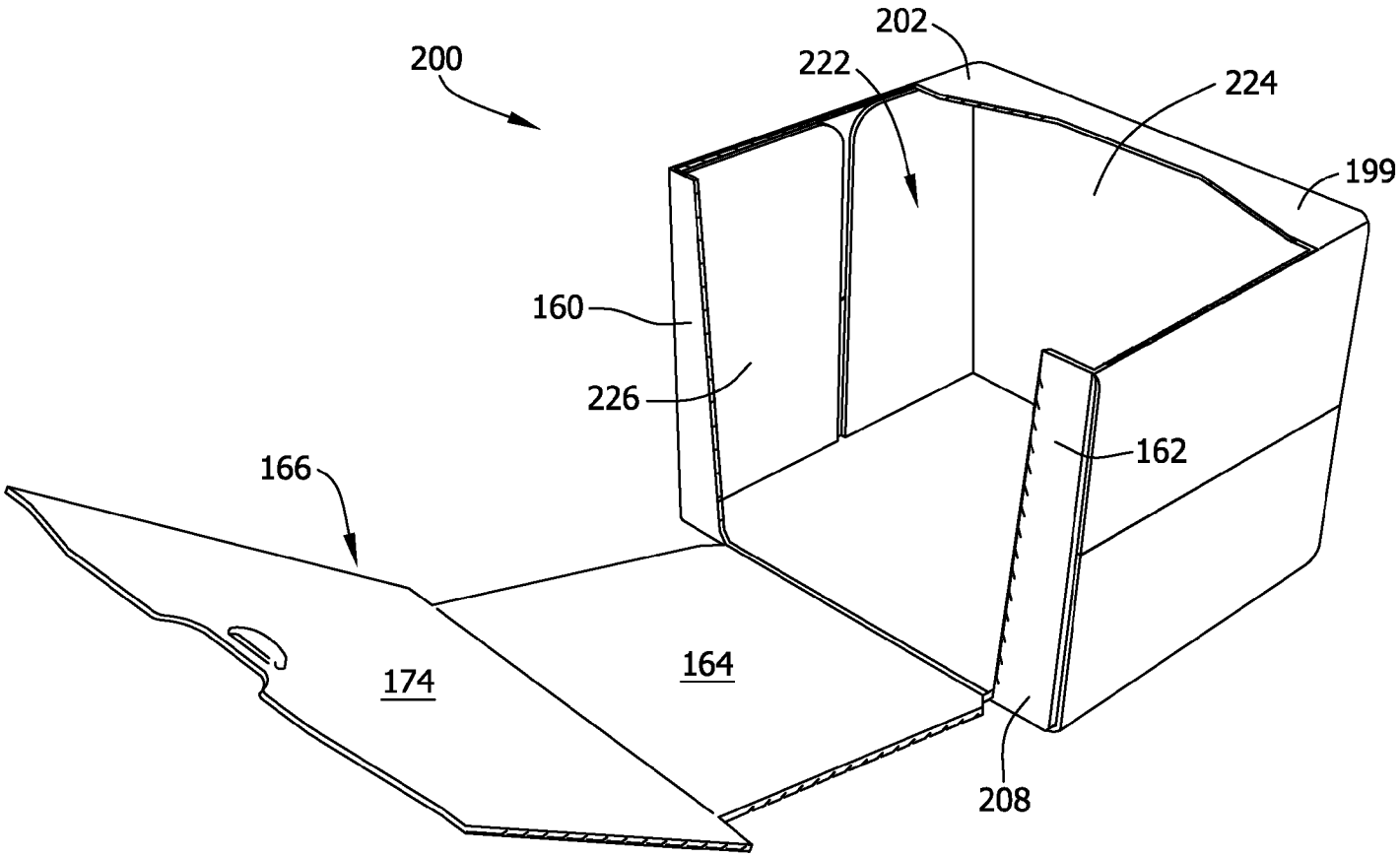

FIG. 4 is a perspective view of an exemplary container 200 formed from blank 100 (shown in FIG. 1) having top 174 and front 164 portions of removable access panel 166 detached. When top portion 174 of removable access panel 166 is detached (shown in FIG. 3) pulling force is continuously applied such that front portion 164 of removable access panel 166 is detached from front wall 208. The force applied causes perforated line 168 to tear away from second shoulder portion 160, perforated line 170 to tear away from bottom wall 204, and perforated line 172 to tear away from first shoulder portion 162. The removal of front portion 164 of removable access panel 166 further exposes cavity 222 inside container 200, in which product will be housed. The removal of front portion 164 of removable access panel 166 also defines a second access opening 226 extending between front shoulder portions 160 and 162 and bottom wall 204 and top wall 202. First and second access openings 224 and 226 make up substantial portions of top and front walls, respectively, and allow for easy viewing and removal of the product. Removable access panel 166 is removed such that substantially all of the product contained within container 200 is viewable. First and second access openings 224 and 226 provide a top and front view of the product or at least a view of the top layer and/or front row of product.

Figure 5:
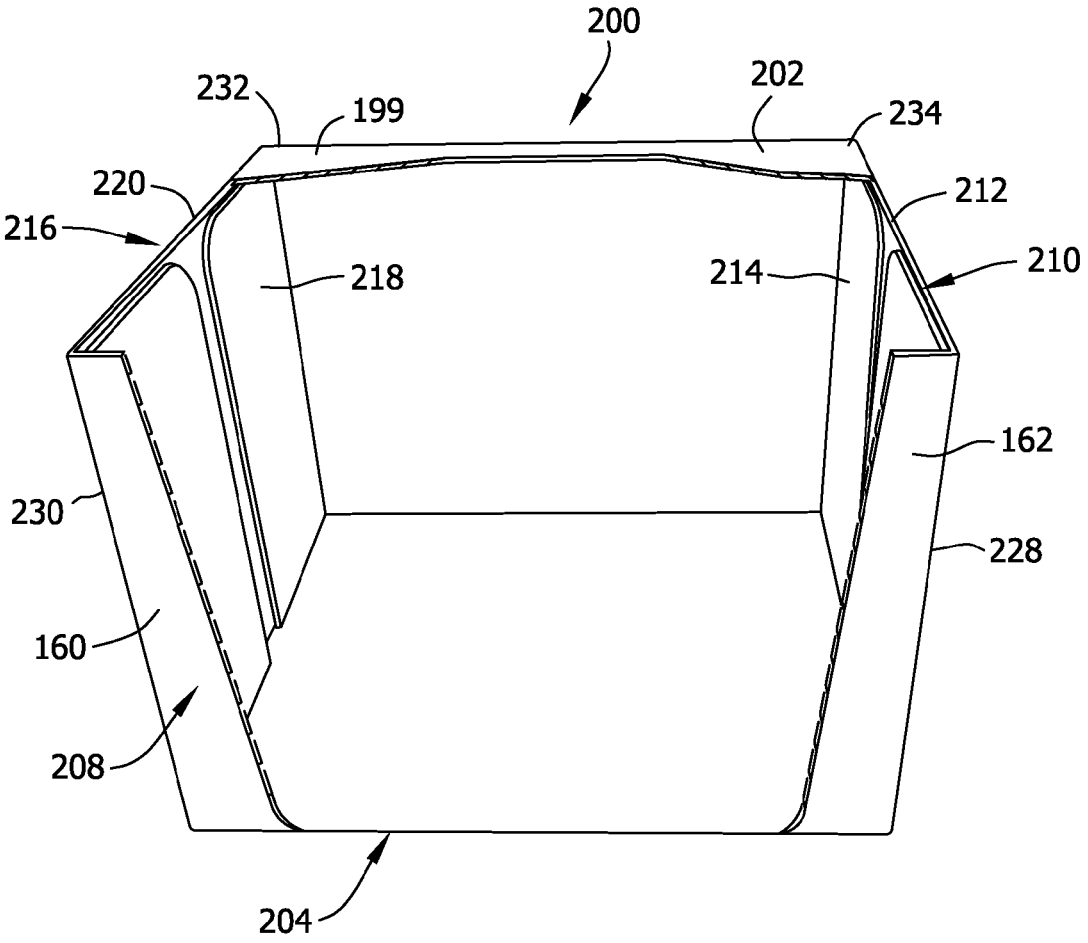

FIG. 5 is a perspective front view of an exemplary container 200 formed from blank 100 (shown in FIG. 1) having removable access panel 166 detached. In the exemplary embodiment, corner structures 228, 230, 232, and 234 are formed by combining walls of container 200. First corner structure 228 is formed by combining first front shoulder portion 162 of front wall 208 and inside and outside layers 212 and 214, respectively, of first side wall 210. First corner structure 228 is bounded by bottom wall 204 and first access opening 224. Second corner structure 230 is formed by combining second shoulder portion 160 of front wall 208 and inside and outside layers 218 and 220, respectively, of second side wall 216. Second corner structure 230 is bounded by bottom wall 204 and first access opening 224. Third and fourth corner structures 232 and 234 are formed by combining rear wall 206, inside and outside layers 218 and 220, respectively, of second side wall 216, and top shoulder portion 199 of top wall 202. Corner structures 228, 230, 232, and 234 of container 200 provide stacking strength to container 200 such that when multiple containers are stacked upon one another, the weight is distributed along corners 228, 230, 232, and 234 to prevent container 200 from collapsing.

Figure 6:
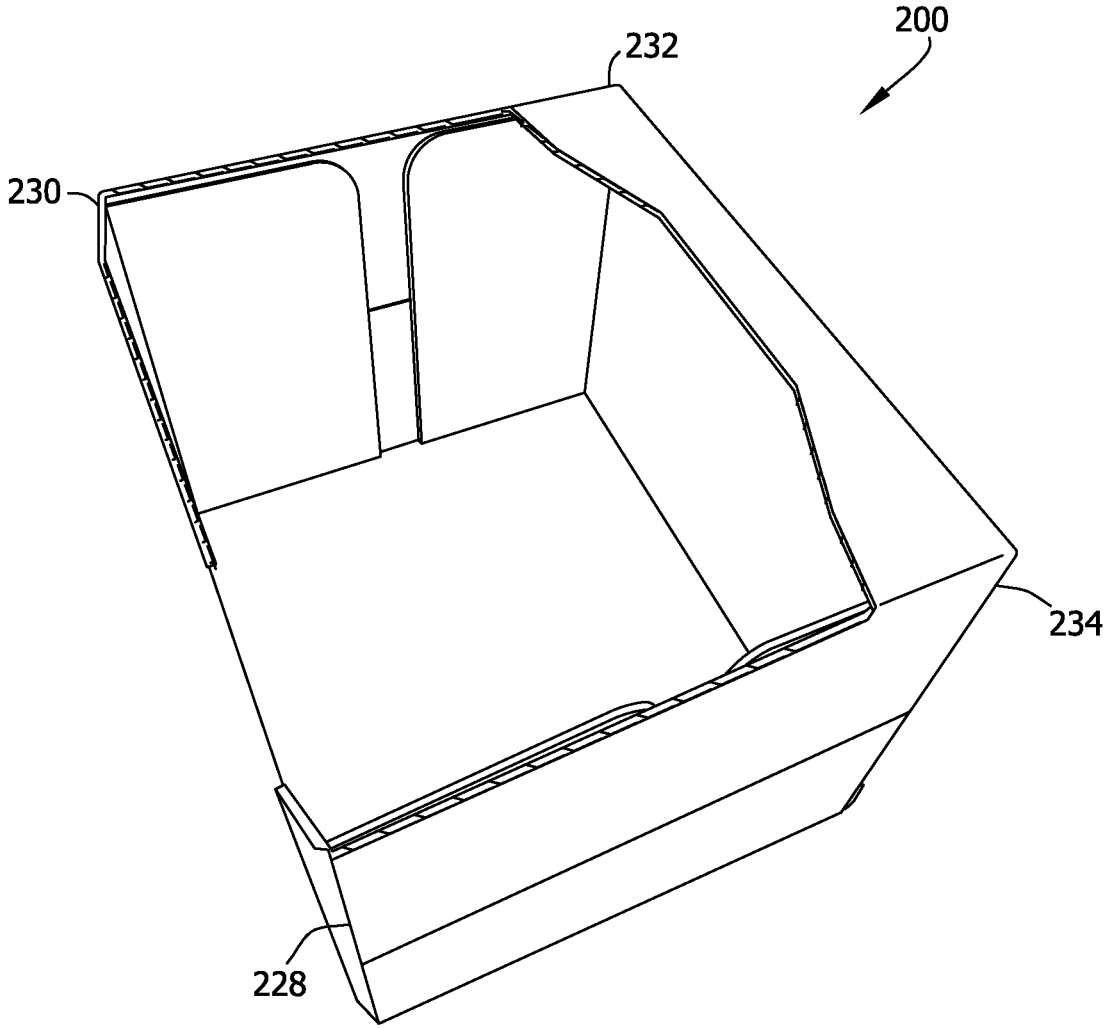

FIG. 6 is a perspective side view of an exemplary container 200 formed from blank 100 (shown in FIG. 1) having removable access panel 166 detached.

First and second access openings 224 and 226, respectively, provide a customer with a good view of the product contained within container 200 and allow for the product to be easily removed without catching on any walls or panels of container 200. Furthermore, corner structures 228, 230, 232, and 234, which are all full columns extending the full height of the container, provide container 200 with structural support to prevent collapse when multiple containers are stacked upon one another during shipping.

Exemplary embodiments of convertible shipping containers having reinforced corners and blanks for making the same are described above in detail. The containers and blanks are not limited to the specific embodiments described herein, but rather, components of the blanks and/or containers may be utilized independently and separately from other components and/or steps described herein. As used herein, "perforated line" is a line of weakness that includes, but is not limited to, perforated lines, cut lines, depressions, or any other weakness configured to facilitate folding, tearing, or separating one portion of a container from a second portion of a container.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A shipping container comprising:

a front wall, a first side wall, a rear wall, and a second side wall, each of said front wall, first side wall, rear wall, and second side wall having top and bottom edges and opposing side edges;

a top wall connected to said front wall along the top edge of said front wall and connected to said rear wall along the top edge of said rear wall, said top wall having opposing side edges;

a bottom wall; and a removable access panel having a front portion and a top portion, wherein said front and top portions are defined by a continuous line of weakness extending from said top wall along at least a portion of said top edge of said first side wall and into said front wall, wherein, when said removable access panel is removed, a first access opening is created within said top wall and a second access opening is created within said front wall, wherein said first access opening comprises a substantial portion of said top wall, and said second access opening comprises a substantial portion of said front wall, wherein the continuous line of weakness extends at least along the top edge of said front wall and within said front wall at a distance spaced from at least one of said opposing side edges of said front wall to at least partially define a first front shoulder portion, wherein at least a portion of a top edge of said first front shoulder portion is a free edge that includes a portion extending from a corner defined between the front wall, the top wall, and at least one of the first and second side walls, the portion extending from the corner and at least partially along the top edge of said front wall when said removable access panel is removed.

2. The shipping container according to claim 1, wherein the continuous line of weakness extends within said front wall at a distance spaced from said opposing side edges and along at least a portion of the bottom edge of said front wall to define said first front shoulder portion and an opposing second front shoulder portion, said first and second shoulder portions extending inwardly from said opposing side edges of said front wall, wherein the combination of said first front shoulder portion and said first side wall define a first corner structure, and wherein the combination of said second shoulder portion and said second side wall define a second corner structure.

3. The shipping container according to claim 2, wherein the continuous line of weakness extends within said top wall along at least a portion of said opposing side edges of said top wall and between said opposing side edges of said top wall defining a top shoulder portion extending between the top edge of said rear wall and a portion of the continuous line of weakness, wherein the top shoulder portion covers at least a portion of a third corner structure and a fourth corner structure.

4. The shipping container according to claim 1, wherein said container further comprises a first, a second, a third, and a fourth corner structure before and after removal of said removable access panel, wherein the first, second, third, and fourth corner structures extend a full height of said container between said bottom wall and said top wall.

5. The shipping container of claim 1, wherein said first side wall is double-walled having an inside layer and an outside layer, wherein said inside layer is comprised of one of opposing front side flaps and one of opposing rear side flaps, and wherein said outside layer is comprised of one of opposing top side flaps and one of opposing bottom side flaps.

6. The shipping container of claim 1, wherein said second side wall is double-walled having an inside layer and an outside layer, wherein said inside layer is comprised of one of opposing front side flaps and one of opposing rear side flaps, and wherein said outside layer is comprised of one of opposing top side flaps and one of opposing bottom side flaps.

7. The shipping container according to claim 1, further including a glue flap extending from said bottom wall, said glue flap configured to couple said bottom wall to said rear wall.

8. The shipping container according to claim 1, wherein said top wall includes an access window and a partially releasable return flap, said access window configured to receive at least one finger of a user, said return flap configured to release upon a force applied by the at least one finger of said user, wherein the configuration of the access window and return flap facilitate removal of said removable access panel.

9. The shipping container according to claim 1, wherein said top wall includes relief creases configured to facilitate removal of said removable access panel.

10. The shipping container according to claim 1, wherein said container is a first container further comprising first, second, third, and fourth corner structures extending a full height of said first container, said corner structures configured to facilitate stacking of at least a second container in a stacked configuration upon said top wall of the first container.

11. The shipping container according to claim 1, wherein said first access opening is configured to display at least a top row of a product contained within the shipping container.

12. The shipping container according to claim 1, wherein said second access opening is configured to display at least a front column of a product contained within the shipping container.

13. A blank of sheet material for forming a shipping container, the blank comprising:

a bottom panel, a front panel, a top panel, and a rear panel coupled in series by a plurality of fold lines, wherein each of said bottom panel, said front panel, said top panel, and said rear panel include opposing side edges;

opposing side flaps coupled by a plurality of fold lines to each of said opposing side edges of each of said bottom panel, said front panel, said top panel, and said rear panel;

a removable access panel having a front portion and a top portion, wherein said front and top portions are defined by a continuous line of weakness extending from said top panel along at least a portion of a first of said side edges of said top panel and into said front panel, wherein when said removable access panel is removed, a first access opening is created within said top panel and a second access opening is created within said front panel, wherein said first access opening comprises a substantial portion of said top panel, and said second access opening comprises a substantial portion of said front panel, wherein the continuous line of weakness extends at least along the fold line between said top panel and said front panel, and extends within said front panel at a distance spaced from at least one of said opposing side edges of said front panel to define a first front shoulder portion, wherein at least a portion of a top edge of said first front shoulder portion is a free edge that includes a portion extending from a corner defined between the front panel, the top panel, and at least one of the opposing side panels when the shipping container is formed, the portion extending from the corner and at least partially along a top edge of said front panel when said removable access panel is removed.

14. The blank according to claim 13, wherein the continuous line of weakness extends within said front panel at a distance spaced from said opposing side edges and along at least a portion of at least one fold line of said front panel to define said first front shoulder portion and an opposing second front shoulder portion, said first and second shoulder portions extending inward from said opposing side edges of said front panel, wherein the combination of said first front shoulder portion and at least one of said opposing side flaps define a first corner structure, and wherein the combination of said second shoulder portion and at least one of said opposing side flaps define a second corner structure.

15. The blank according to claim 14, wherein the continuous line of weakness extends within said top panel along at least a portion of said opposing side edges of said top panel and between said opposing side edges of said top panel defining a top shoulder portion extending between at least one of said plurality of fold lines and a portion of the continuous line of weakness, wherein the top shoulder portion covers at least a portion of a third corner structure and a fourth corner structure.

16. The blank according to claim 13, wherein said top panel comprises said top shoulder portion and said top portion of removable access panel.

17. The blank according to claim 13, wherein said front panel comprises said first front shoulder portion, said second front shoulder portion, and said front portion of removable access panel, wherein said front portion extends between said first and second front shoulder portions.

18. The blank according to claim 13, wherein said blank further comprises a first, a second, a third, and a fourth corner structure before and after removal of said removable access panel, wherein the first, second, third, and fourth corner structures extend a full length of opposing side edges of said front and rear panels.

19. The blank according to claim 13, further including a glue flap extending from said bottom panel configured to couple said bottom panel to said rear panel.

20. The blank according to claim 13, wherein said top panel includes an access window and a partially releasable return flap, said access window configured to receive at least one finger of a user, said return flap configured to release upon a force applied by the at least one finger of said user, wherein the configuration of the access window and return flap facilitate removal of said removable access panel.

21. The blank according to claim 13, wherein said top panel includes relief creases configured to facilitate removal of said removable access panel.

22. A method of forming a shipping container from a blank of sheet material, the blank comprising a bottom panel, a front panel, a top panel, and a rear panel coupled in series by a plurality of fold lines, wherein each of said bottom panel, said front panel, said top panel, and said rear panel include opposing side edges, the blank further comprising opposing side flaps coupled by a plurality of fold lines to each of said opposing side edges of each of said bottom panel, said front panel, said top panel, and said rear panel, the blank also comprising a removable access panel having a front portion and a top portion, wherein said front and top portions are defined by a continuous line of weakness extending from said top panel panel along at least a portion of a first of said side edges into said front panel, the continuous line of weakness further extending at least along the fold line between said top panel and said front panel, and extending within said front panel at a distance spaced from at least one of said opposing side edges of said front panel to define a first front shoulder portion, the method comprising:

forming an open sided partially-formed box from said bottom panel, said front panel, said top panel, and said rear panel, said open sided partially-formed box comprising bottom, front, top, and rear walls;

rotating said opposing side flaps of said front and rear panels about said fold lines toward interior of said open sided partially-formed box;

rotating said opposing side flaps of said top and bottom panels about said fold lines toward interior of said open sided partially-formed box;

coupling opposing side flaps of said front and rear panels to opposing side flaps of said top and bottom panels to form a first and second side wall; and removing said removable access panel such that a first access opening is created within said top wall and a second access opening is created within said front wall, and such that at least a portion of a top edge of said first front shoulder portion is a free edge that includes a portion extending from a corner defined between the front panel, the top panel, and at least one of the opposing side panels when the shipping container is formed, the portion extending from the corner and at least partially along a top edge of said front panel, wherein said first access opening comprises a substantial portion of said top panel, and said second access opening comprises a substantial portion of said front panel.

23. The method of claim 22, wherein the blank further includes a glue panel, said method comprising:

applying adhesive to said glue panel;

coupling said glue panel to said rear panel.

24. The method of claim 22, wherein removing said access panel includes utilizing relief creases, an access window, and a return flap to apply a pulling force to facilitate removal of said removable access panel.

* * * * *